US005597081A

United States Patent [19]

Shirley

[11] Patent Number: 5,597,081

[45] Date of Patent: Jan. 28, 1997

[54] PORTABLE CRANE

[76] Inventor: Kirk B. Shirley, 2705 Bay Meadow Cir., Dallas, Tex. 75234

[21] Appl. No.: 413,348

[22] Filed: Mar. 30, 1995

[51] Int. Cl.[6] ..... B66C 23/78

[52] U.S. Cl. ..... 212/299; 212/241; 212/294; 187/239

[58] Field of Search ..... 212/179, 294, 212/295, 296, 298, 299, 241, 263, 342, 166, 901; 187/239, 242; 414/10

[56] References Cited

U.S. PATENT DOCUMENTS

| | | | |
|---|---|---|---|
| 1,958,824 | 5/1934 | Jones | 214/95 |
| 2,375,799 | 5/1945 | Le Tourneau | 212/8 |
| 2,675,209 | 4/1954 | Freed | 254/2 |
| 2,879,902 | 3/1959 | Wilcox | 212/8 |
| 3,310,291 | 3/1967 | Wiggins | 254/173 |
| 3,794,296 | 2/1974 | Hasstedt | 254/8 B |
| 4,049,238 | 9/1977 | Brown | 254/139.1 |
| 4,050,587 | 9/1977 | Moen | 212/59 R |
| 4,135,627 | 1/1979 | McInerney | 212/8 R |
| 4,503,983 | 3/1985 | Lew | 212/187 |
| 4,730,742 | 3/1988 | Feteri | 212/189 |
| 4,782,962 | 11/1988 | Hackworth et al. | 212/195 |
| 4,801,117 | 1/1989 | Take | 212/299 |
| 5,224,612 | 7/1993 | Shirley | 212/187 |
| 5,341,898 | 8/1994 | Baziuk | 212/299 |

FOREIGN PATENT DOCUMENTS

| | | | |
|---|---|---|---|
| 500053 | 12/1950 | Belgium . | |
| 752222 | 2/1967 | Canada . | |
| 553324 | 5/1923 | France . | |
| 185234 | 4/1907 | Germany . | |
| 779237 | 11/1980 | U.S.S.R. | 187/239 |
| 941076 | 11/1963 | United Kingdom . | |

*Primary Examiner*—Thomas J. Brahan

*Attorney, Agent, or Firm*—Ross, Clapp, Korn & Montgomery, L.L.P.

[57] ABSTRACT

A portable crane operable between a first, extended position for lifting loads and a second collapsed position for transportation includes a handle having first and second ends. A boom having first and second ends is provided such that the first end is pivotally interconnected to the first end of the handle. The boom extends outwardly from the first end of the handle in the crane first position and is disposed parallel to the handle in the crane second position. Structure is provided for supporting the handle first end and extends in a direction opposite the boom in the crane second position. A pair of outriggers anchor guy cables on the first end of the handle. A cable extends between the handle second end and the boom second end for receiving a load, such that as the cable is retracted, a load is lifted toward the boom second end.

16 Claims, 4 Drawing Sheets

22c
24
10
19
70
28
22c
22b
17
104c
68
104
74
74
18b
104a
62
13a
16
78
32
22
78
13
14a
68
12a
25
12
44
13a
13b
27a
18
68
24b
104b
104b
14
22
14a
68
18a
14
22a
20a
33
22a
20b
14
20b
108
72
110a
26
20c
12b
76
110
27
20d
60
20c
110c
48
110c
48
76
50
50
110b
110b
27b
38

40
38
52
40b
112
40a
36

PORTABLE CRANE

TECHNICAL FIELD OF THE INVENTION

This invention relates to a hoisting machine, and more particularly to an improved mechanism for manually hoisting and maneuvering heavy and bulky objects onto a rooftop.

BACKGROUND OF THE INVENTION

This invention contains a number of improvements to the portable crane described in U.S. Pat. No. 5,224,612. Previously, a number of improvements for machines capable of lifting heavy objects onto rooftops have been proposed. However, such mechanisms have had limited load capacity, limited lifting height, have been overly mechanized, and required large amounts of access. Excepting the said portable crane, these machines require special installation, extensive setup and operation and, are expensive.

A need has thus arisen for a more practical mechanism suitable for hoisting a heavy, bulky object, such as for example, an air conditioner condensing unit onto a roof, without the need for special installation or a heavy counterweight with improved capacity, stability and ergonomics. Such improvements allow for a more stable design, increased durability of parts, faster setup, increased load capacity and operator convenience. Such a mechanism requires good reliability, reduced costs of operation and easy setup.

SUMMARY OF THE INVENTION

In accordance with the present invention, a portable crane operable between a first, extended position for lifting loads and a second, collapsed position for transportation, is provided. The crane includes a handle having first and second ends. A boom having first and second ends is provided such that the first end is pivotally interconnected to the first end of the handle. The boom extends outwardly from the first end of the handle in the crane first position and is disposed parallel to the handle in the crane second position. The crane includes a pair of outriggers for anchoring guy cables and structure for supporting the handle first end. Supporting structure and outriggers are disposed in opposite directions centered on the first end of the handle in the crane first position and provides a framework for guy cables to brace the handle and boom. The supporting structure and outriggers are disposed generally parallel to the handle in the crane second position. A cable extends between the handle second end and the boom second end for receiving loads, such, that as the cable is retracted, a load is lifted toward the boom second end.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
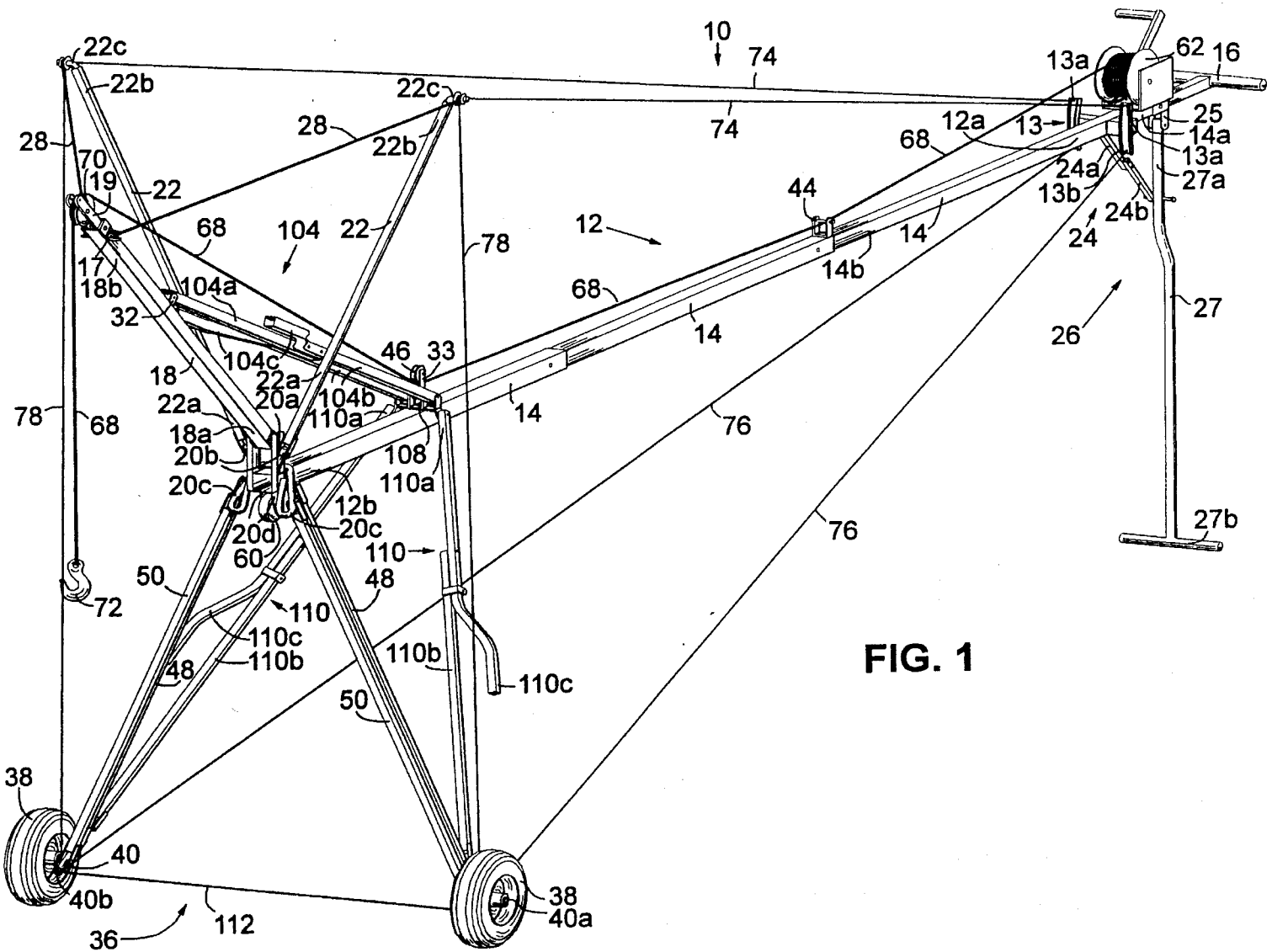
FIG. 1 is a perspective view of the present portable crane in the extended position.
Figure 2:
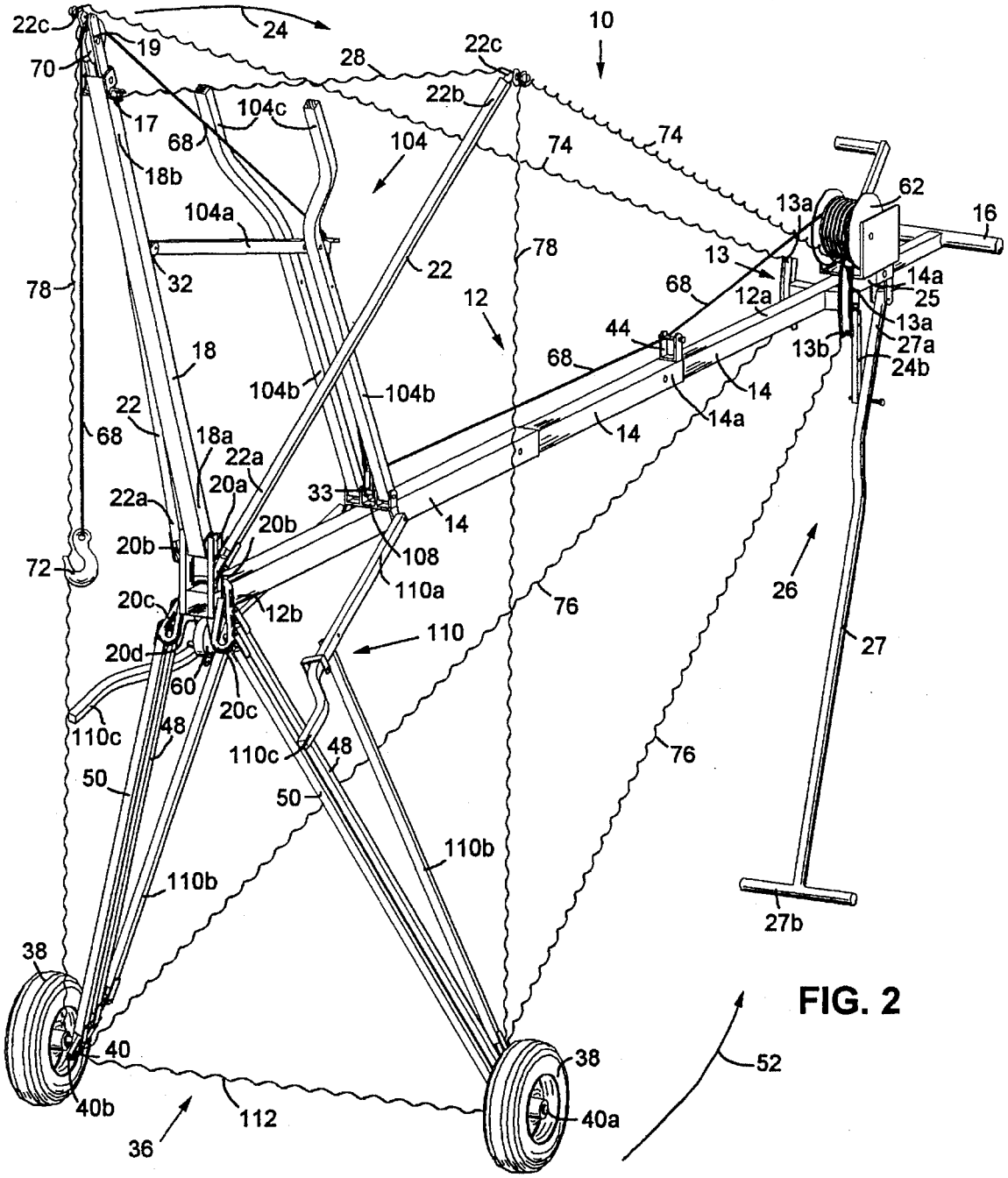
FIG. 2 is a perspective view of the present portable crane shown in FIG. 1 in a partially collapsed position.
Figure 3:
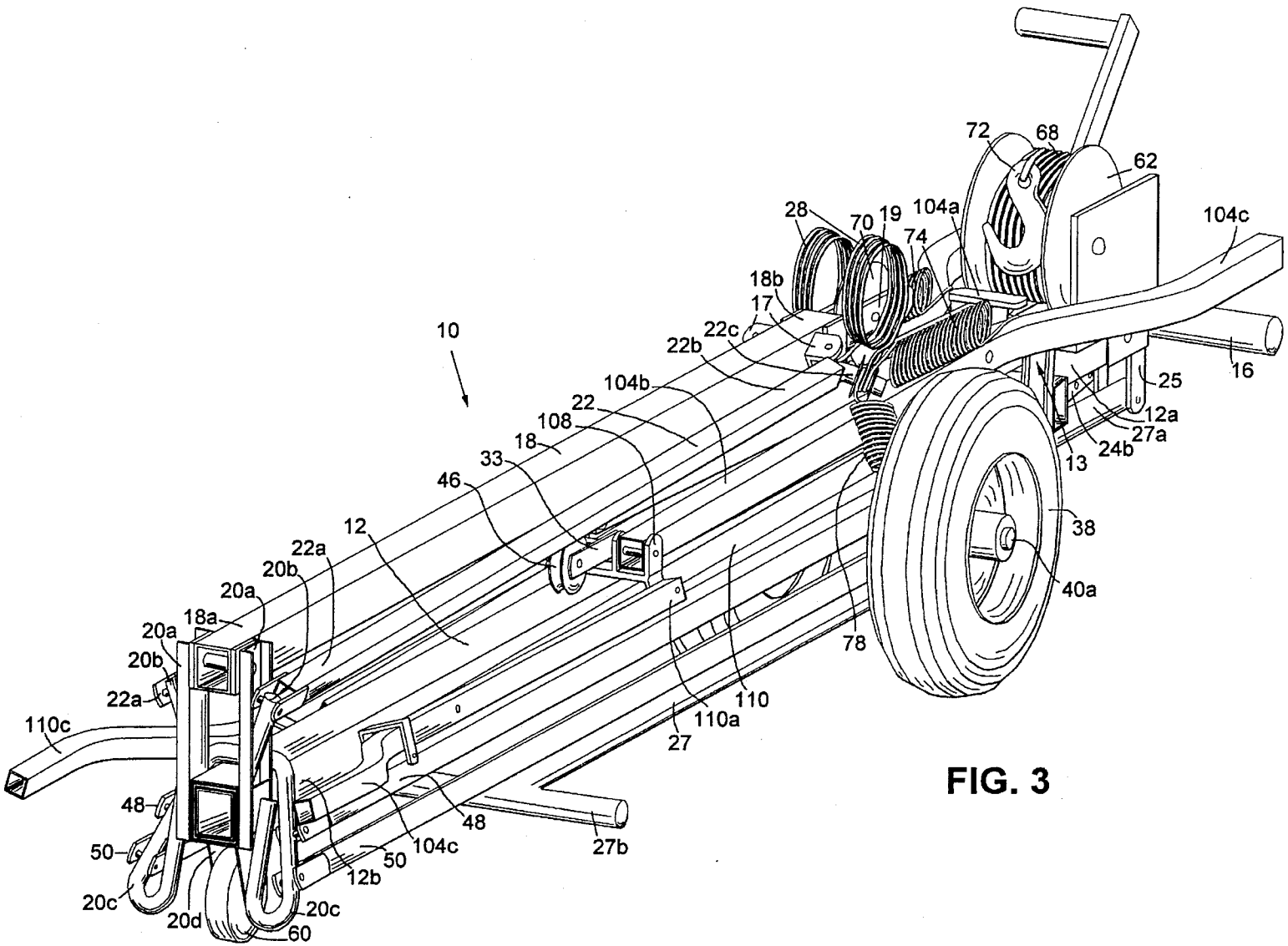
FIG. 3 is a perspective view of the present portable crane shown in FIG. 1 in the collapsed position.

Referring simultaneously to FIGS. 1, 2, and 3, the present portable crane is illustrated, and is generally identified by the numeral 10. FIG. 1 illustrates crane 10 in its fully extended position for operation. FIG. 2 and FIG. 3 illustrate portable crane 10 in an intermediate and fully collapsed position for transportation, respectively. Portable crane 10 includes a collapsible handle 12 having ends 12*a* and 12*b*. Handle 12 may include, for example, a plurality of telescoping sections 14 which are illustrated in FIG. 1 as being fully extended and collapsed in FIGS. 2 and 3. End 12*a* of handle 12 includes a grip 16.

Figures 4, 5, 6:
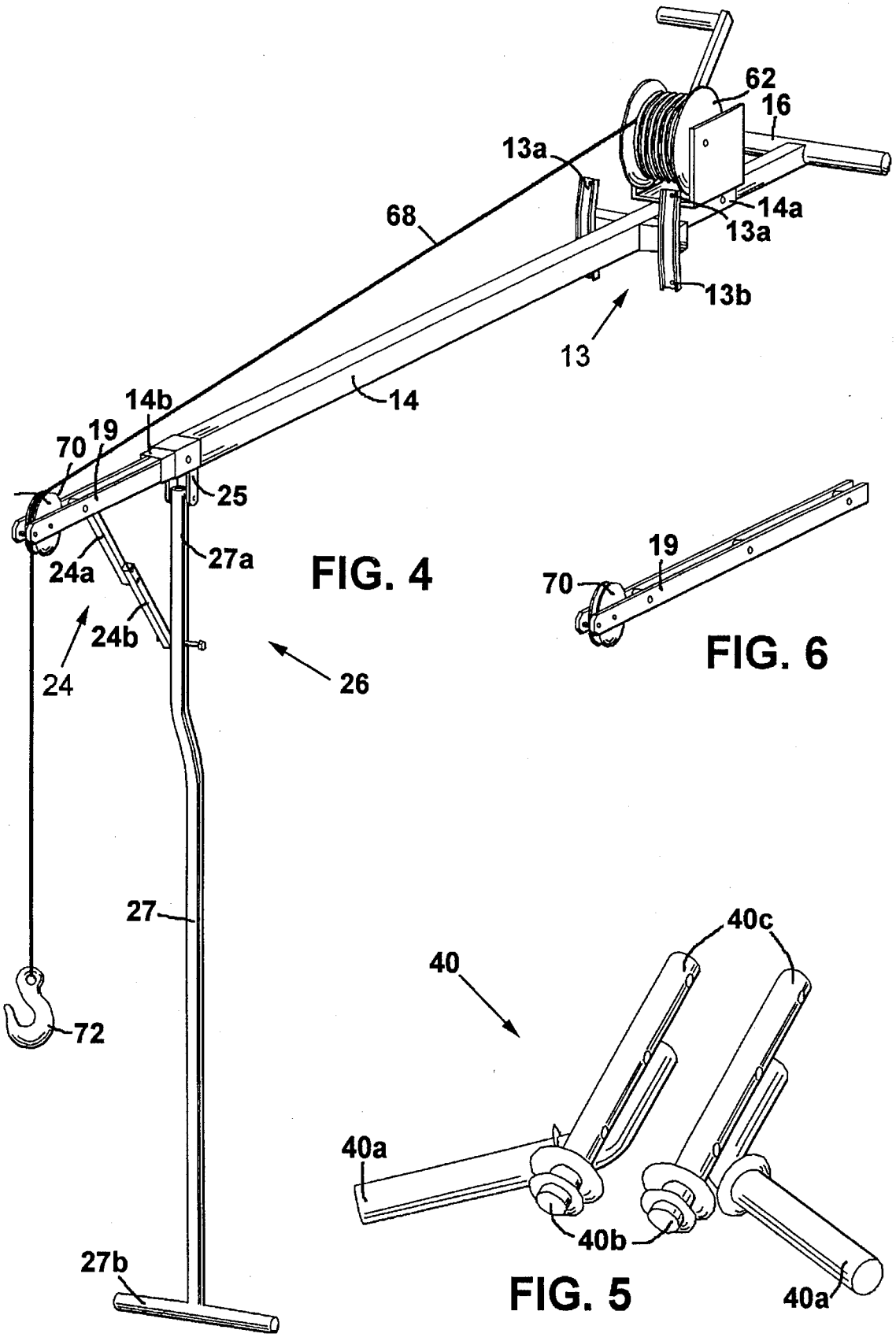
FIG. 4 is a perspective view of a second embodiment of the present portable crane.
FIG. 5 is a perspective view of the axles of the present portable crane shown in FIG. 1.
FIG. 6 is a perspective view of the boom extension of the present portable crane shown in FIG. 1.

Pivotally interconnected to end 12*b* of handle 12 is a boom 18 having ends 18*a* and 18*b*. End 18*a* is pivotally interconnected to end 12*b* of handle 12 through a bracket 20*a*. Boom 18 pivots between the extended position as illustrated in FIG. 1 to a retracted position, by rotating in the direction of arrow 24 (FIG. 2) to the retracted position, parallel to handle 12, as shown in FIG. 3. Boom extension 19 of boom 18 has one main, and two extended positions as Shown in FIG. 6. The two extended positions allow for progressively taller, bulkier loads with the trade off of reduced capacity of crane 10.

A brace member 104 interconnects intermediate of boom 18 and handle 12, and is composed of a pair pivotally interconnected sections 104*a* and 104*b*. Section 104*a* is interconnected to boom 18 utilizing bracket 32. Sections 104*b* consist of a pair of supports interconnected to handle 12 utilizing a bracket 108. Brace member 104 minimizes bending moments generated within portable crane 10 and prevents these bending moments from being introduced into handle 12.

A pair of outriggers 22 extend perpendicular and outward from end 12*b* of handle 12 of crane 10 illustrated in FIG. 1. Outriggers 22 generally consist of ends 22*a* and 22*b*. Ends 22*a* of outriggers 22 are pivotally interconnected to end 12*b* of handle 12 through bracket 20*b* such that outriggers 22 lie parallel to handle 12 in the collapsed position of crane 10 as illustrated in FIG. 3. Ends 22*b* of outriggers 22 include end posts 22*c* with two rings for receiving top guy cables 74, guy cables 28 and guy cables 78, which allow the looped end of guy cables 74 to be removed without removing any hardware. Outriggers 22 allow guy cables 74, guy cables 28, and guy cables 78 to meet at a point. The forces generated by guy cables 74, guy cables 28, and guy cables 78 cancel each other out with a resultant force that only puts the outriggers 22 in compression.

End 22*b* of the outriggers 22 and a bracket 13 of end 12*a* of handle 12 are interconnected utilizing guy cables 74 to maintain stability of handle 12 and to raise the boom 18 when grip 16 is pushed downward. Axles 40 and end 12*a* of handle 12 are interconnected utilizing guy cables 76 to maintain stability of handle 12 and to lower boom 18 when grip 16 is raised. End 22*b* of the outriggers 22 and end 18*b* of boom 18 at ring 17 are interconnected utilizing guy cables 28 to maintain stability of boom 18 and prevent boom 18 from tilting over laterally under heavy loads. Axles 40 and end 22*b* of the outriggers 22 are interconnected utilizing guy cables 78 to maintain the outriggers 22 from rising and to maintain stability of boom 18.

Bracket 13 of second end 12*a* of handle 12 anchors the top guy cables 74 and bottom guy cables 76 at points 13*a*, and 13*b*, respectively forming "spread points" which give the handle a chance to flex due to guy cable stretch with increased loads, yet still keep all the forces in the guy cables canceling each other out. As long as the center line of end 12*b* of handle 12 remains within the window comprising top point 13*a*, and bottom point 13*b*, all the forces in guy cables cancel each other out and will remain in balance and the crane handle 12 is prevented from bending.

Portable crane 10 further includes a fixed caster 60, which is pivotally interconnected to a bracket 20*d* of end 12*b* of handle 12. Fixed caster 60 allows the crane 10 to roll in the fully collapsed position as illustrated in FIG. 3. The function of fixed caster 60 is to aid in loading the crane 10 for transportation and allowing crane 10 to roll up the side of a wall when being lifted up to a rooftop.

Portable crane 10 further includes an undercarriage, generally identified by the numeral 36, which is interconnected to end 12*b* of handle 12. Undercarriage 36 allows portable crane 10 to be easily transported in both the extended position as illustrated in FIG. 1 and the fully collapsed position as illustrated in FIG. 3. Undercarriage 36 includes a pair of wheels 38. Wheels 38 are mounted on ends 40*a* of axles 40 that are pivotally interconnected to a pair of supports 110 having members 110*a* and 110*b*. Axles 40 are interconnected utilizing a cable 112 to maintain wheels from spreading. Member 110*b* is pivotally interconnected to axle 40 of wheel 38. Likewise member 110*a* is pivotally interconnected to bracket 108. Member 110*b* is hinged to axle 40 to allow member 110*a* to pivot such that member 110*b* lies adjacent to end 12*b* of handle 12 in the fully collapsed position of portable crane 10 as illustrated in FIG. 3. Axles 40 of wheels 38 are also interconnected to pretzel shaped bracket 20*c* of end 12*b* of handle 12 using two pair of braces 48 and 50. Pretzel shaped bracket 20*c* allows braces 48 and 50 to have a stronger connection and maintain a symmetric design. Both pair of braces 48 and 50 extend between axle 40 and pretzel shaped bracket 20*c*. Both pair of braces 48 and 50 are pivotally interconnected such that undercarriage 36 is collapsible in the direction of arrow 52 (FIG. 2) to allow undercarriage 36 to lie parallel to handle 12 in the fully collapsed position as illustrated in FIG. 3.

FIG. 5 shows axles 40 which include an end post 40*b* with two rings for receiving guy cables 76 and cable 112, which allow the end loop of guy cables 76 to be removed without removing wheels 38. End 40*a* of axles 40 are designed such that both pair of braces 48 and 50 are in compression sharing the weight of the load equally.

Portable crane 10 further includes a stand assembly, generally identified by the numeral 26, which is interconnected to end 12*a* of handle 12. Stand assembly 26 includes stand 27, member 24 and bracket 25. End 27*a* of stand 27 is pivotally interconnected to bracket 25. Bracket 25 is inter connected to end 12*a* of handle 12. End 27*b* of stand 27 includes a foot. Stand 27 is pivotally interconnected to bracket 25 to allow stand 27 to pivot such that stand 27 lies adjacent to end 12*a* of handle 12 in the fully collapsed position of portable crane 10 as illustrated in FIG. 3. Member 24*b* is pivotally interconnected to stand 27. Member 24*a* is pivotally interconnected to end 12*a* of handle 12. Members 24*a* and 24*b* are hinged to lay adjacent to stand 27 and end 12 of handle 12 in the fully collapsed position.

Portable crane 10 further includes a winch 62 mounted to end 12*a* of handle 12. Winch 62 may be hand operated or motor driven. Winch 62 includes a cable 68 that extends through cable guide 44 on end 14*b* of section 14, under lower pulley 46 interconnected to bracket 33 and over a pulley 70 interconnected to boom extension 19 of boom 18. Bracket 33 is pivotally interconnected to bracket 108 of handle 12. Lower pulley 46 is used to eliminate the bending moments in handle 12 caused by a load on cable 68. Cable 68 includes a hook 72 which is received by a load.

In operation of portable crane 10, handle telescoping sections 14 of handle 12 are telescoped outwardly from the position shown in FIG. 3 to the fully extended position as shown in FIG. 1. Guy cables 74 and 76 uncoil. Subsequently, the handle 12 is lifted at end 12*b* and the undercarriage 36 is deployed from the position shown in FIG. 3 to the fully extended position as shown in FIG. 1. Supports 110 are toggled by the operator pushing the grip 110*c* downward. Boom 18 is lifted and deployed from the position shown in FIG. 3 to the fully extended position as shown in FIG. 1. Simultaneously, as boom 18 is lifted, guy cables 28 lift and deploy outriggers 22 from the position shown in FIG. 3 to the fully extended position as shown in FIG. 1. Support 104 is toggled by the operator pulling the grips 104*c* downward which simultaneously tension all guy cables in one motion.

In operation of portable crane 10, wheels 38 are chocked and end 12*b* of handle 12 at grip 16 may be secured to a stable structure. Winch 62 is unspooled and hook 72 is attached to a load. Winch 62 is then spooled either manually or by motorized winch. Once the load has been winched up into place, portable crane 10 and the load can be driven or manually maneuvered into place by the operator.

Referring now simultaneously to FIGS. 1 and 4, an additional use for the present portable crane 10 will now be described. FIG. 4 illustrates the use of the crane 120 assembled utilizing a handle telescoping member 14, boom extension 19 and stand assembly 26. Stand assembly 26 is removed from member end 14*a* of member 14 and is reattached to member end 14*b* of member 14. Boom extension 19 is removed from boom end 18*b* of boom 18 of crane 10 and is inserted into member end 14*b* of member 14. The crane is easily carried by a person up a ladder. The crane may also be utilized by a single operator to lift the other components of portable crane 10 to a roof for further use. In operation of the crane, an operator holds grip 16 to operate winch 62. Member 14 is supported using stand assembly 26 for use, for example, on a roof top.

Although the description above contains many specificities, these should not be construed as limiting the scope of the invention but as merely providing illustrations of some of the presently preferred embodiments of this invention. For example, the outriggers could be telescoping rather than hinged, and guy cables could be replaced by chain.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A portable crane operable between a first, extended position for lifting loads and a second, collapsed position for transportation, comprising:

a handle having first and second ends;

a boom having first and second ends, said first end being pivotally interconnected to said first end of said handle and extending outwardly from said first end of said handle in the crane first position and being disposed parallel to said handle in the crane second position;

means for supporting said handle first end and extending opposite said boom in the crane first position and disposed generally parallel to said handle in the crane second position;

a cable extending between said handle second end and said boom second end for receiving loads, such that as said cable is retracted, loads are lifted toward said boom second end; and means for bracing said boom and said handle in the crane first position including:

first and second outriggers each having first and second ends, said first ends thereof being pivotally interconnected to said handle and extending outwardly and perpendicularly to said handle in the crane first position and being disposed parallel to said handle in the crane second position;

a first top guy cable extending between said handle second end and said first outrigger second end;

a second top guy cable extending between said handle second end and said second outrigger second end;

a first bottom guy cable extending between said handle second end and said handle support means;

a first side guy cable extending between said handle support means and said first outrigger second end;

a second side guy cable extending between said handle support means and said second outrigger second end;

a first front guy cable extending between said first outrigger second end and said second end of said boom; and a second front guy cable extending between said second outrigger second end and said second end of said boom.

2. The portable crane of claim 1 and further including:

a second bottom guy cable extending between said handle second end and said handle support means.

3. The portable crane of claim 1 wherein said handle includes a plurality of telescoping members operable between an extended position in the crane first position and a retracted position in the crane second position.

4. The portable crane of claim 1 wherein said means for supporting said handle first end includes:

a first wheel having a first axle;

a second wheel having a second axle;

means for interconnecting said first and second wheels to said first end of said handle, such that in the crane second position said wheels are disposed parallel to and adjacent to said handle.

5. A portable crane operable between a first, extended position for lifting loads and a second, collapsed position for transportation, comprising:

a handle having first and second ends and including a plurality of telescoping members operable between an extended position in the crane first position and a retracted position in the crane second position;

a boom having first and second ends, said first end being pivotally interconnected to said first end of said handle and extending outwardly from said first end of said handle, in the crane first position and being disposed parallel to said handle in the crane second position;

means for supporting said handle first end and extending opposite said boom in the crane first position and disposed generally parallel to said handle in the crane second position;

a cable extending between said handle second end and said boom second end for receiving loads, such that as said cable is retracted, loads are lifted toward said boom second end;

first and second outriggers each having first and second ends, said first ends thereof being pivotally interconnected to said handle and extending outwardly and perpendicularly to said handle in the crane first position and being disposed parallel to said handle in the crane second position;

a first top guy cable extending between said handle second end and said first outrigger second end;

a second top guy cable extending between said handle second end and said second outrigger second end;

a first bottom guy cable extending between said handle second end and said handle support means;

a first side guy cable extending between said handle support means and said first outrigger second end;

a second side guy cable extending between said handle support means and said second outrigger second end;

a first front guy cable extending between said first outrigger second end and said second end of said boom; and a second front guy cable extending between said second outrigger second end and said second end of said boom.

6. The portable crane of claim 5 and further including:

a second bottom guy cable extending between said handle second end and said handle support means.

7. The portable crane of claim 6 and further including:

a bracket having first and second spaced apart anchor points interconnected to said second end of said handle;

said bracket first anchor point interconnected to said first top guy cable and said first bottom guy cable; and said bracket second anchor point interconnected to said second top guy cable and said second bottom guy cable.

8. The portable crane of claim 5 wherein said means for supporting said handle first end includes:

a first wheel having a first axle;

a second wheel having a second axle;

means for interconnecting said first and second wheels to said first end of said handle, such that in the crane second position said wheels are disposed parallel to and adjacent to said handle.

9. The portable crane of claim 8 and further including:

a bracket interconnected to said first end of said handle for pivotally interconnecting said means for interconnecting said first and second wheels to said first end of said handle.

10. The portable crane of claim 5 and further including:

means for supporting said second end of said handle and extending downward and perpendicularly to said handle in the crane first position and being disposed parallel to said handle in the crane second position.

11. The portable crane of claim 5 wherein said boom includes a telescoping member operable between an extended position in the crane first position and a retracted position in the crane second position.

12. The portable crane of claim 5 and further including:

a bracket mounted between said first and second ends on said handle for restraining said cable extending between said handle second end and said boom second end.

13. The portable crane of claim 5 and further including:

a fixed caster interconnected to said first end of said handle for transporting the crane in the crane second position.

14. The portable crane of claim 5 and further including:

a pulley pivotally interconnected adjacent said handle first end for redirecting forces in said cable such that bending moments in said handle are reduced.

15. A portable crane configurable in a first mode operable between a first, extended position for lifting loads and a second, collapsed position for transportation; and a second mode, comprising:

a handle having first and second ends and including a plurality of detachable handle sections;

a boom having a multiposition telescoping member operable at multiple extended or retracted positions in the crane first position and a retracted position in the crane second position;

a boom extension being detachable from said boom in the first mode and interconnected to one of said plurality of handle sections, such that said boom extension is inserted into the first end of said handle section in the second mode;

a support being detachable from said second end of said handle in the first mode and interconnected to one of said plurality of handle sections, such that said support is connected to said first end of said handle section in the second mode;

means for supporting said handle first end in the first mode and extending opposite said boom extension in the crane first position and disposed generally parallel to said handle in the crane second position: and a cable extending between said handle second end and said boom second end in the first mode and said cable extending between said boom extension and said second end of said handle in the second mode such that as said cable is retracted, a load is lifted toward said boom second end.

16. The portable crane of claim 15 wherein said handle includes a plurality of telescoping members operable between an extended position in the crane first position and a retracted position in the crane second position.

* * * * *